US008246207B2

(12) United States Patent
Chen et al.

(10) Patent No.: US 8,246,207 B2
(45) Date of Patent: Aug. 21, 2012

(54) LED SOLAR TRAFFIC MARKING PANEL FITTED WITH INTEGRATED DIMMING CONTROLLER

(75) Inventors: Yi-Qun Chen, Taichung (TW); Shuei-Tian Cai, Taichung (TW)

(73) Assignee: Safety Traffic Equipment Co., Ltd., Taichung (TW)

( * ) Notice: Subject to any disclaimer, the term of this patent is extended or adjusted under 35 U.S.C. 154(b) by 465 days.

(21) Appl. No.: 12/649,514

(22) Filed: Dec. 30, 2009

(65) Prior Publication Data

US 2011/0156926 A1 Jun. 30, 2011

(51) Int. Cl.
*F21L 4/00* (2006.01)

(52) U.S. Cl. ..... 362/253; 362/183; 362/234; 340/907; 315/291; 40/557

(58) Field of Classification Search ..... 362/183, 362/253, 234, 431, 394, 800, 812; 40/541, 40/553, 557; 315/158, 291; 340/907
See application file for complete search history.

(56) References Cited

U.S. PATENT DOCUMENTS 4,441,143 A * 4/1984 Richardson, Jr. ..... 362/183
6,092,318 A * 7/2000 Arie et al. ..... 40/547
7,178,279 B2 * 2/2007 Molvidson et al. ..... 40/444

* cited by examiner

*Primary Examiner* — Bao Q Truong
(74) *Attorney, Agent, or Firm* — Egbert Law Offices PLLC

(57) ABSTRACT

A multifunctional integrated dimming controller and an LED solar traffic marking panel fitted with this controller. The multifunctional integrated dimming controller is applied to the marking panel for combining and controlling its dimming function. The multifunctional integrated dimming controller includes a controller casing having an assembly surface and a terminal coupling portion. A contact block of solar photovoltaic panel is assembled on the coupling portion and connected with the solar photovoltaic panel. A contact block is assembled on the terminal coupling portion and connected with the electrical storage device. An LED contact block is assembled on the coupling portion and connected with the LED unit. An external sensing contact block is assembled on the coupling portion and connected with the external sensor. An integrated electrical control module is accommodated into the controller casing including a circuit board, a dimming processor on the circuit board and an electrical control unit.

17 Claims, 4 Drawing Sheets

LED SOLAR TRAFFIC MARKING PANEL FITTED WITH INTEGRATED DIMMING CONTROLLER

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a multifunctional integrated dimming controller, and more particularly to an innovative LED solar traffic marking panel fitted with this dimming controller.

2. Description of Related Art Including Information Disclosed Under 37 CFR 1.97 and 37 CFR 1.98

Given the fact that conventional traffic marking panels are difficult to identify for marking, indicating or warning purposes during night-time or during poorer weather conditions (e.g. rainy or foggy weather), an LED light-emitter that is assembled onto the pattern, letter or frame of traffic marking panel has been developed in this industry.

An LED light-emitter is often applied to a traffic marking panel, but it has significant power consumption in the event of extensive use. For this reason, an LED is designed to combine with solar a power generating device and an ambient light sensing device for perfect energy conservation and environmental protection.

However, with the growing complexity of light-emitting and electrical control structures of a traffic marking panel, the assembly and connection of its circuits becomes a very important technological challenge. This is because, once an LED of traffic marking panel is combined with a solar power generating device and sensing device, various units such as a solar photovoltaic panel, a storage battery, and LED unit and sensor, are required to be connected electrically through perfect design of an integrated structure. Otherwise, this will affect directly the assembly performance of the light-emitting control mechanism, or indirectly its service life, maintenance and safety.

Thus, to overcome the aforementioned problems of the prior art, it would be an advancement if the art to provide an improved structure that can significantly improve the efficacy.

Therefore, the inventor has provided the present invention of practicability after deliberate experimentation and evaluation based on years of experience in the production and development of related products.

BRIEF SUMMARY OF THE INVENTION

The enhanced efficacy of the present invention is as follows:

Based on the unique structural configuration of the present invention that the multifunctional integrated dimming controller is assembled onto the LED solar traffic marking panel, the LED marking panel, solar photovoltaic panel, electrical storage device and ambient light differential sensor can be combined and connected, so the dimming functions of LED solar traffic marking panel can be integrated for easier assembly and higher applicability.

The improvements brought about by this invention are as follows:

First, based on the structural configuration wherein the heat-radiating fins are set onto the controller casing assembly surface, the heat generated by the multifunctional integrated dimming controller can be dissipated to prevent overheating and extend the service life.

Next, based on the structural configuration wherein the multifunctional integrated dimming controller also comprises the blink control contact block, it is possible to control the simultaneous or alternated blink modes among different LED units, thus providing more light-emitting modes and improving the marking effect.

Finally, based on the structural configuration wherein the multifunctional integrated dimming controller also comprises the brightness percentage contact block, it is possible to resolve the time-dependent brightness decay of LED.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Figure 1:
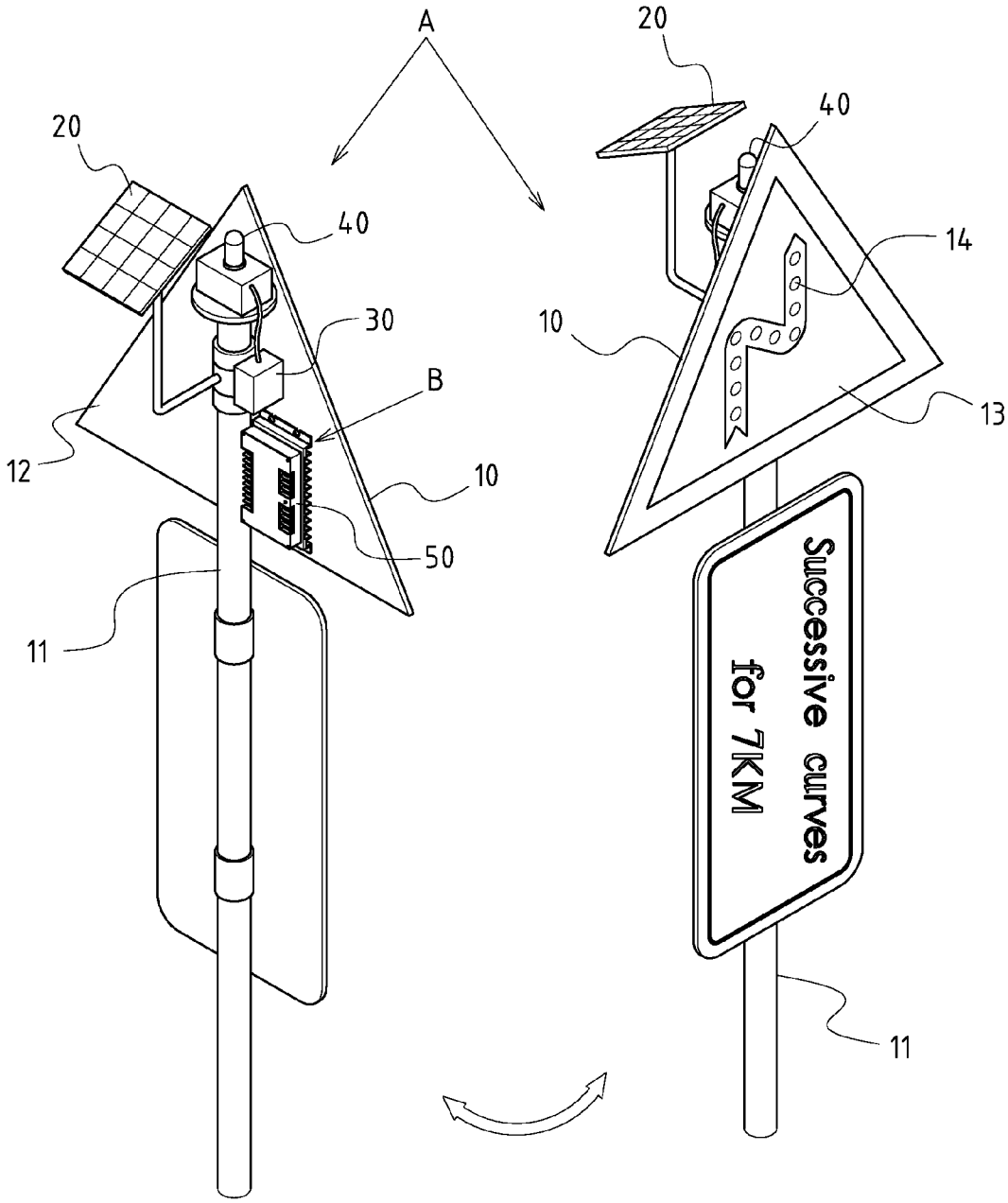
FIG. 1 shows a perspective view of the preferred embodiment of LED solar traffic marking panel of the present invention.
Figure 2:
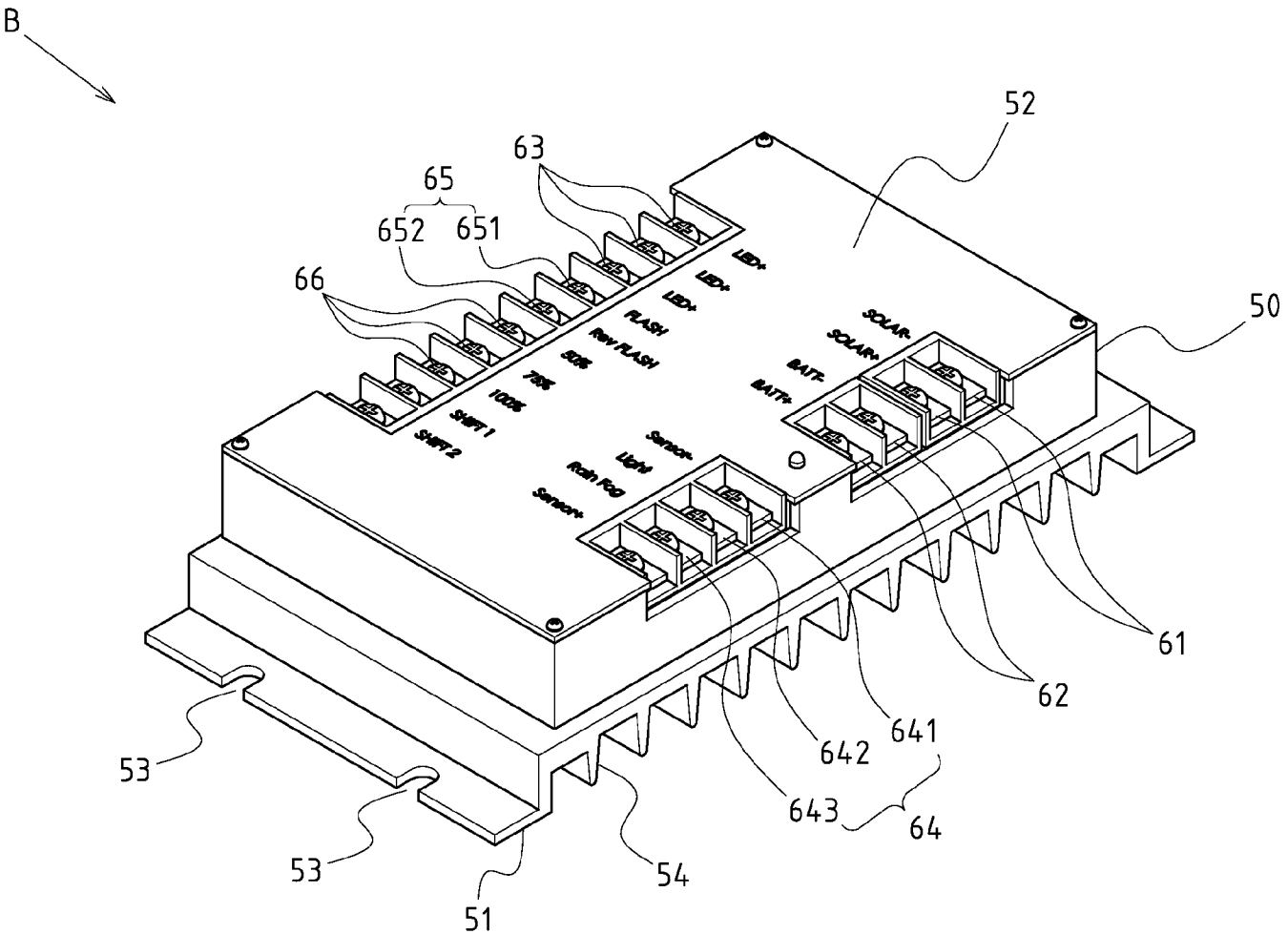
FIG. 2 shows a perspective view of the assembled preferred embodiment of multifunctional integrated dimming controller of the present invention.
Figure 3:
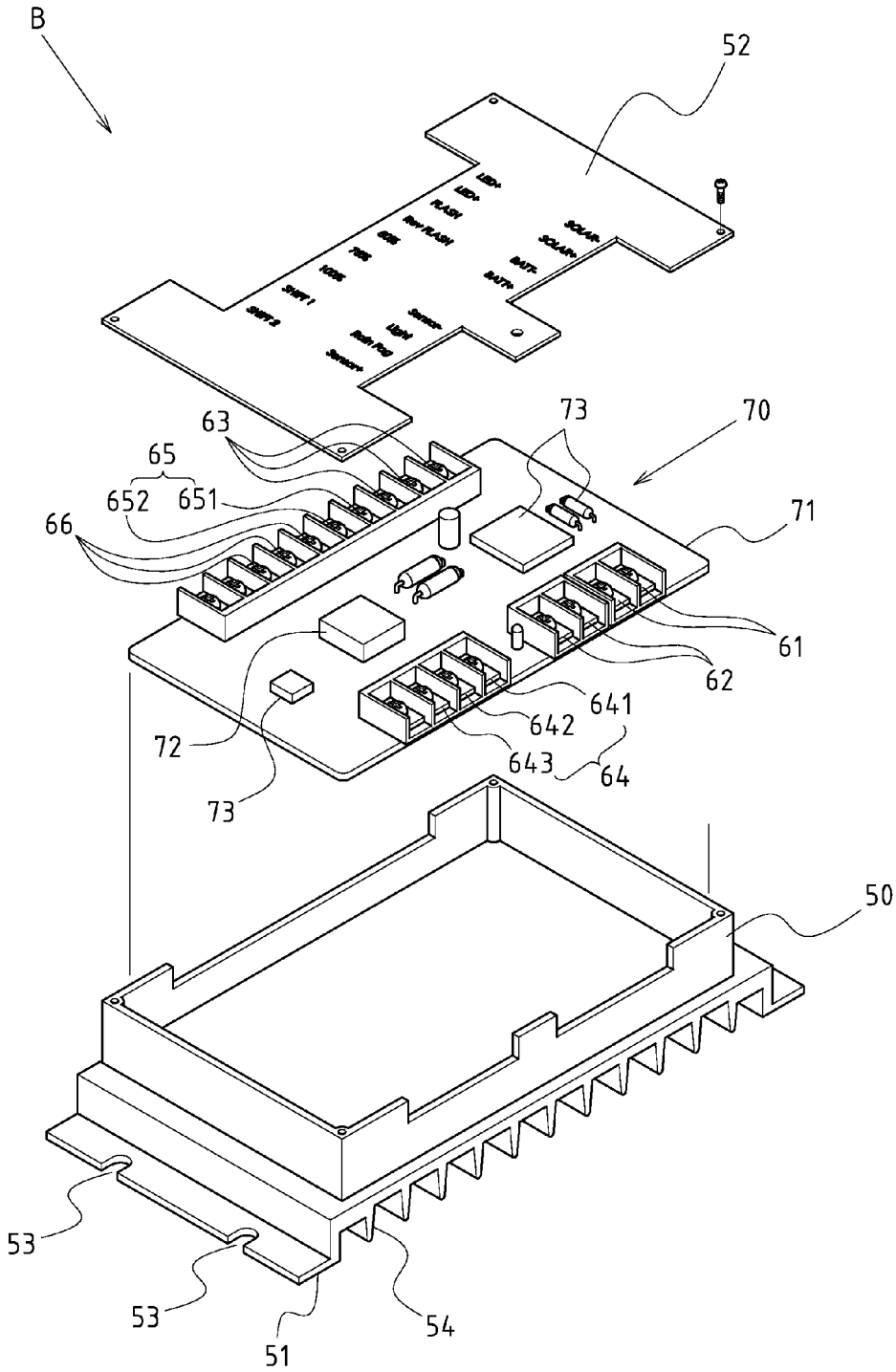
FIG. 3 shows an exploded perspective view of the preferred embodiment of multifunctional integrated dimming controller of the present invention.

FIGS. 1-3 depict preferred embodiments of an LED solar traffic marking panel of the present invention fitted with an integrated dimming controller which are provided for only explanatory objective for patent claims. Said LED solar traffic marking panel A includes an LED marking panel 10 having a locating portion 11 (e.g. a pole or rack), a back 12, a traffic marking surface 13 and multiple LED units 14 set on the traffic marking surface 13. A solar photovoltaic panel 20 is assembled overhead the back 12 of the LED marking panel 10 for receiving sunlight. An electrical storage device 30 is assembled onto the LED marking panel 10 (e.g. back 12 of the LED marking panel 10), so as to store the electric power generated by the solar photovoltaic panel 20. An ambient light differential sensor 40 is assembled onto the LED marking panel 10 (e.g. back 12 of the LED marking panel 10), so as to obtain the ambient light information. A multifunctional integrated dimming controller B is assembled onto the LED marking panel 10, so as to combine and control the dimming function of the LED solar traffic marking panel A. Referring to FIGS. 2, 3, the multifunctional integrated dimming controller B includes a controller casing 50, further comprising an assembly surface 51 and a terminal coupling portion 52. A contact block of solar photovoltaic panel 61 is set on the terminal coupling portion 52 and connected electrically with the solar photovoltaic panel 20. A contact block of electrical storage device 62 is set on the terminal coupling portion 52 and connected electrically with the electrical storage device 30. An LED contact block 63 is set on the terminal coupling portion 52 and connected electrically with the LED unit 14. An external sensing contact block 64 is set on the terminal coupling portion 52 and connected electrically with the external sensor. An integrated electrical control module 70 is accommodated into the controller casing 50. Referring to FIG. 3, the integrated electrical control module 70 comprises: a circuit board 71, a dimming processor 72 (e.g. MCU) on the circuit board 71 and an electrical control unit 73. The contact blocks (i.e. 61-64) are connected electrically with the integrated electrical control module 70.

Figure 4:
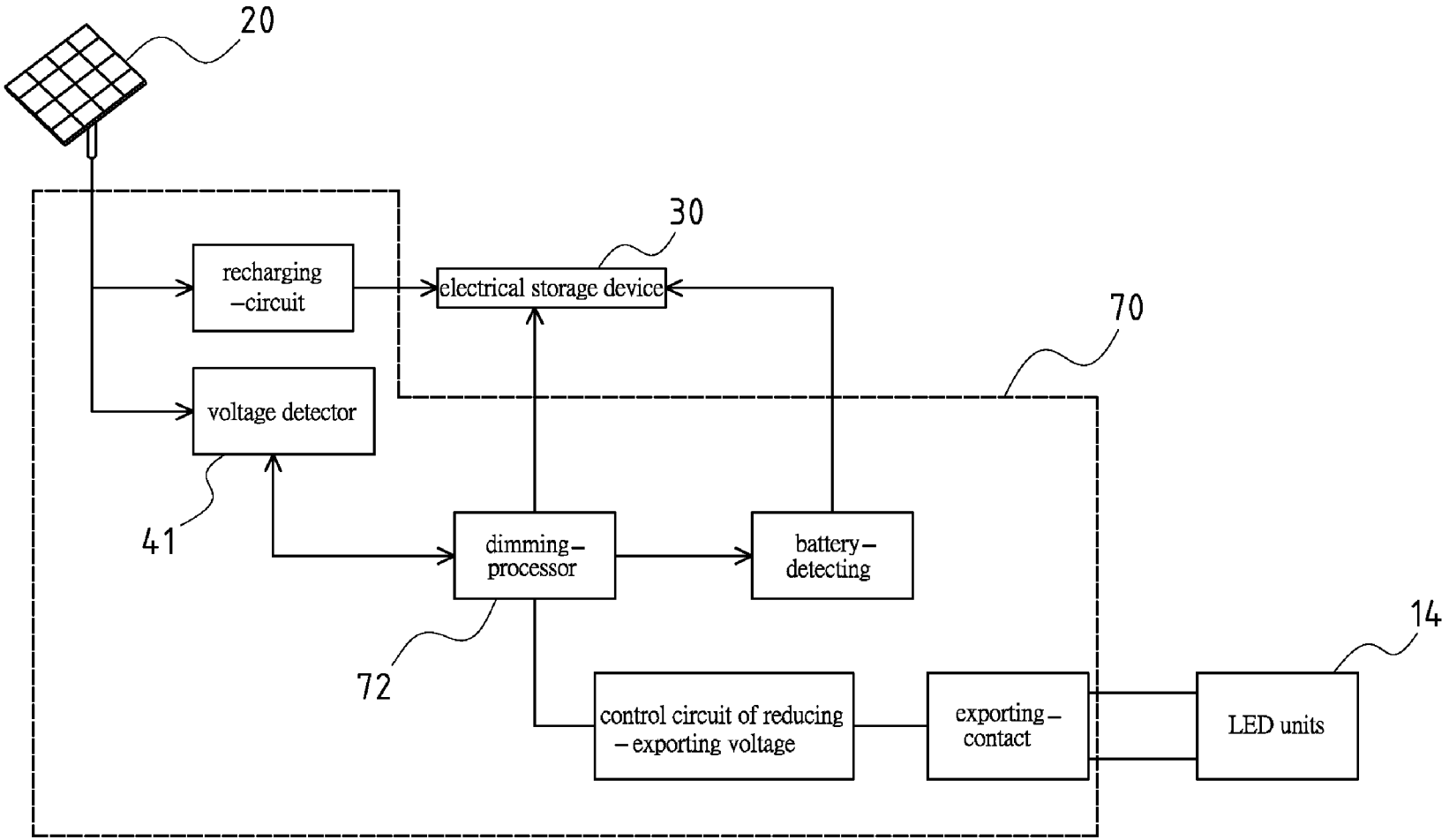
FIG. 4 shows a schematic view of the electrical control system of the present invention.

Of which, the ambient light differential sensor 40 is an optical sensor that may obtain the ambient light information by directly sensing the intensity of ambient light. Alternatively, the ambient light differential sensor 40 is also a voltage detector 41 that is coupled with the integrated electrical control module 70 (shown in FIG. 4), and used to detect the voltage of the activated solar photovoltaic panel 20, helping users to judge the intensity of ambient light (note: a higher voltage means stronger intensity, and vice versa) and obtain the information of ambient light.

Referring to FIGS. 2 and 3, a locking hole 53 is set on the assembly surface 51 of the controller casing 50 of the multifunctional integrated dimming controller B, allowing one to screw the bolt on a preset location and locate the assembly state of the multifunctional integrated dimming controller B. Moreover, heat-radiating fins 54 are arranged at interval on the assembly surface 51 of the controller casing 50, so as to dissipate the heat generated by the multifunctional integrated dimming controller B, thereby preventing overheating and extending the service life.

The multifunctional integrated dimming controller B also comprises a blink control contact block 65, which contains a positive blink contact 651 and negative blink contact 652 to control the simultaneous or alternated blink modes among different LED units 14.

The multifunctional integrated dimming controller B also comprises a brightness percentage contact block 66, which permits one to select several contacts for resolving the time-dependent brightness decay of LED according to the brightness state of LED unit 14 of the LED solar traffic marking panel A (e.g. 50%, 75% and 100%).

Of which, the external sensing contact block 64 of the multifunctional integrated dimming controller B covers either of the following contacts or combination modes: (1) Object sensor contact 641, used for electrical connection of an external object sensor; the object sensor is available with multiple functions, such as: vibration sensor for level crossing, or IR sensor for the approaching persons or vehicles; (2) Temperature sensor contact 642, used for electrical connection of an external temperature sensor; said temperature sensor is suitable for controlling the light-emitting brightness in chilly environment; (3) Rain & fog sensor contact 643, used for electrical connection of an external rain& fog sensor; the rainy or foggy weather is a decisive factor to the brightness, which requires highlighting of the LED unit 14 of the LED solar traffic marking panel A for an optimized efficiency; (4) Water level sensor contact, used for electrical connection of an external water level sensor; it is used to strengthen the light-emitting effect of traffic marking panel when a warning water level of bridges is reached; or (5) External signal contact, used for electrical connection of an external signal source; it is used for connection with the signal source, rather than with the external sensor; said signal source is referred to the signal line of level crossing lamp, which permits synchronization of the light-emitting state of the traffic marking panel with the level crossing signal.

Based on the above-specified structural configuration, the present invention is operated as follows:

The products covered by the present invention comprise a multifunctional integrated dimming controller B, and an LED solar traffic marking panel A fitted with the multifunctional integrated dimming controller B.

With the configuration of the multifunctional terminal contact blocks (i.e. 61-64) and the integrated electrical control module 70, said multifunctional integrated dimming controller B allows the LED unit 14, solar photovoltaic panel 20, electrical storage device 30, ambient light differential sensor 40 of LED solar traffic marking panel A and other external sensors to be combined and connected by a single controller. So, the LED solar traffic marking panel A can be operated functionally in such a manner that the multifunctional integrated dimming controller B can switch on/off automatically LED unit 14 according to the information of the ambient light differential sensor 40, and also adjust the brightness of LED unit 14 (shown in FIG. 4—a block diagram of electrical control system), with a reference to the message of other external sensors (e.g. object sensor, temperature sensor, rain and fog sensor and water level sensor or external signals), as well as the generating state of the solar photovoltaic panel 20 and the power state of electrical storage device 30.

We claim:

1. A multifunctional integrated dimming controller, suitable for an LED solar traffic marking panel, used to combine and control the dimming function of the LED solar traffic marking panel; the multifunctional integrated dimming controller comprising:

- a controller casing comprising: an assembly surface and a terminal coupling portion;
- a contact block of solar photovoltaic panel assembled on the terminal coupling portion;
- a contact block of electrical storage device assembled on the terminal coupling portion;
- an LED contact block assembled on the terminal coupling portion;
- an external sensing contact block assembled on the terminal coupling portion;
- an integrated electrical control module accommodated into the controller casing; the integrated electrical control module comprises:
  - a circuit board,
  - a dimming processor on the circuit board and an electrical control unit; the contact blocks are connected electrically with the integrated electrical control module.

2. The structure defined in claim 1, wherein a locking hole is set on the assembly surface of the controller casing.

3. The structure defined in claim 1, wherein heat-radiating fins are arranged at interval on the assembly surface of the controller casing.

4. The structure defined in claim 1, wherein the multifunctional integrated dimming controller also comprises a blink control contact block, which contains a positive blink contact and negative blink contact to control the simultaneous or alternated blink modes among different LED units.

5. The structure defined in claim 1, wherein the multifunctional integrated dimming controller also comprises a brightness percentage contact block, which permits to select several contacts for resolving the time-dependent brightness decay of LED according to the brightness state of LED unit of the LED solar traffic marking panel.

6. The structure defined in claim 1, wherein the external sensing contact block covers either of the following contacts or combination modes:

(1) object sensor contact;

(2) temperature sensor contact;

(3) rain and fog sensor contact;

(4) water level sensor contact; or (5) external signal contact.

7. The structure defined in claim 1, wherein the multifunctional integrated dimming controller also comprises an ambient light differential sensor to obtain the ambient light information.

8. The structure defined in claim 7, wherein the ambient light differential sensor is an optical sensor that may obtain the ambient light information by directly sensing the intensity of ambient light.

9. The structure defined in claim 7, wherein the ambient light differential sensor is also a voltage detector that is used to detect the voltage of the activated solar photovoltaic panel, helping users to judge the intensity of ambient light and obtain the information of ambient light.

10. An LED solar traffic marking panel, comprising:

an LED marking panel comprising:

a locating portion;

a back;

a traffic marking surface; and multiple LED units set on the traffic marking surface;

a solar photovoltaic panel; assembled overhead the back of the LED marking panel;

an electrical storage device; assembled onto the LED marking panel to store the electric power generated by the solar photovoltaic panel;

an ambient light differential sensor; assembled onto the LED marking panel to obtain the ambient light information;

a multifunctional integrated dimming controller assembled onto the LED marking panel, so as to combine and control the dimming function of the LED solar traffic marking panel; the multifunctional integrated dimming controller comprises:

a controller casing, comprising an assembly surface and a terminal coupling portion;

a contact block of solar photovoltaic panel; set on the terminal coupling portion, and connected electrically with the solar photovoltaic panel;

a contact block of electrical storage device, set on the terminal coupling portion, and connected electrically with the electrical storage device;

an LED contact block; set on the terminal coupling portion, and connected electrically with the LED unit;

an external sensing contact block, set on the terminal coupling portion, and connected electrically with the external sensor;

an integrated electrical control module, accommodated into the controller casing; the integrated electrical control module comprises a circuit board, a dimming processor on the circuit board and an electrical control unit; the contact blocks are connected electrically with the integrated electrical control module.

11. The structure defined in claim 10, wherein the ambient light differential sensor is an optical sensor that may obtain the ambient light information by directly sensing the intensity of ambient light.

12. The structure defined in claim 10, wherein the ambient light differential sensor is also a voltage detector that is used to detect the voltage of the activated solar photovoltaic panel, helping users to judge and obtain the ambient light information.

13. The structure defined in claim 10, wherein a locking hole is set on the assembly surface of the controller casing.

14. The structure defined in claim 10, wherein heat-radiating fins are arranged at interval on the assembly surface of the controller casing.

15. The structure defined in claim 10, wherein the multifunctional integrated dimming controller also comprises a blink control contact block, which contains a positive blink contact and negative blink contact to control the simultaneous or alternated blink modes among different LED units.

16. The structure defined in claim 10, wherein the multifunctional integrated dimming controller also comprises a brightness percentage contact block, which permits selection of several contacts for resolving the time-dependent brightness decay of LED according to the brightness state of LED unit of the LED solar traffic marking panel.

17. The structure defined in claim 10, wherein the external sensing contact block of multifunctional integrated dimming controller covers either of the following contacts or combination modes:

(1) object sensor contact, used for electrical connection of an external object sensor;

(2) temperature sensor contact, used for electrical connection of an external temperature sensor;

(3) rain and fog sensor contact, used for electrical connection of an external rain and fog sensor;

(4) water level sensor contact, used for electrical connection of an external water level sensor; or (5) external signal contact, used for electrical connection of an external signal source.

* * * * *